United States Patent [19]

Harris

[11] 4,288,948

[45] Sep. 15, 1981

[54] RETAIL STORE

[75] Inventor: Ronald J. Harris, Toronto, Canada

[73] Assignee: Sterling Merchandise Co., Akron, Ohio

[21] Appl. No.: 121,831

[22] Filed: Feb. 15, 1980

[51] Int. Cl.[3] ..... E04H 3/04

[52] U.S. Cl. ..... 52/28; D6/146; D6/169; D6/171; D25/56; D25/58; D25/59

[58] Field of Search ..... 52/33, 36, 38, 311, 52/484; D6/143, 146, 169, 171; D20/38; D25/56, 59

[56] References Cited

U.S. PATENT DOCUMENTS

| | | | |
|---|---|---|---|
| Re. 17,178 | 1/1929 | Trapp | 52/33 |
| D. 76,910 | 11/1928 | Berland | D25/59 |
| D. 121,494 | 7/1940 | Mann | D25/56 X |
| D. 183,049 | 6/1958 | Holderle et al. | D25/56 X |
| 1,345,481 | 7/1920 | Davis | 52/33 |
| 1,350,088 | 8/1920 | Tribble | 52/33 |
| 1,392,418 | 10/1921 | Hill | 52/33 |
| 1,404,613 | 1/1922 | Hormes | 52/33 X |
| 1,461,374 | 7/1923 | Anderson | 52/33 |
| 1,463,633 | 7/1923 | Smith | 52/33 |
| 1,474,106 | 11/1923 | Carroll | 52/33 |
| 1,528,243 | 3/1925 | Briggs | 52/33 |
| 1,717,123 | 6/1929 | Sharp | 52/33 X |
| 1,861,671 | 6/1932 | Webb | 52/31 X |
| 2,285,962 | 6/1942 | Foulkes | 52/33 X |
| 3,181,274 | 5/1965 | Izenowi | 52/484 X |
| 3,742,932 | 7/1973 | Greenspan | 52/33 X |

FOREIGN PATENT DOCUMENTS

| | | | |
|---|---|---|---|
| 1553088 | 12/1968 | France | 52/36 |
| 238400 | 8/1925 | United Kingdom | 52/33 |

*Primary Examiner*—Alfred C. Perham
*Attorney, Agent, or Firm*—Reese Taylor

[57] ABSTRACT

A retail store arrangement having perimeter walls and a floor and ceiling, has the perimeter walls enclosing at least two sides of the store area and joined by a cross wall to enclose a selling area. Wall mounted display cases are disposed along at least one of the perimeter walls with the perimeter walls terminating in end display units. Freestanding display cases are disposed in spaced relationship with respect to the perimeter walls and, in some embodiments, further freestanding display islands are provided in the selling area. The store is characterized by a unique combination of reflective surfaces on the ceiling and on at least part of the wall surfaces and vertical surfaces of the various display units and a combination of two basic colors which are utilized on some of the vertical surfaces to provide a "first" color and on some of the vertical surfaces and the floor surface to provide a "second" color. A further feature of the arrangement is the provision of a canopy or drop ceiling which is configured complementally to the configuration of at least some of the display units or display islands so as to create a harmonious and unitary impression. The store is designed to have outstanding aesthetic qualities without any sacrifice whatsoever of the utility of the structural feature and to obtain maximum utility of the structural features and to obtain maximum utilization of the available floor space while creating a feeling of spaciousness.

8 Claims, 14 Drawing Figures

RETAIL STORE

FIELD OF THE INVENTION

This invention relates, in general, to a store arrangement and relates in particular to a retail store arrangement particularly advantageous for selling jewelry or related items.

DESCRIPTION OF THE PRIOR ART

Applicant is aware, from observation, of many variations in store layout and design wherein the allotted space is intended to be utilized with maximum efficiency while presenting the merchandise in the most attractive and desirable manner. Applicant, however, is unaware of any store layout or arrangement utilizing his unique combination of first and second colors and reflective surfaces together with angularly displayed display units and canopies or drop ceilings conforming to that configuration.

Applicant is also aware of certain prior art patents relating to various types of store arrangements.

Thus for example, Davis U.S. Pat. No. 1,345,481 discloses a self-serve store arrangement characterized primarily of a sales room having a continuous aisle that is primarily designed to permit ready access to the stock room while permitting the customers to pass through the store in such a way as to avoid confusion.

Hill U.S. Pat. No. 1,392,418 discloses another self-service type store arrangement wherein the shelving is arranged so as to effectively utilize the store space while permitting ready observation thereof to avoid theft.

Hormes U.S. Pat. No. 1,404,613 is primarily directed to a means for illustrating proposed store installations and primarily is directed to a means for displaying to prospective store owners the way in which the merchandise and the store fixtures would be laid out.

Anderson U.S. Pat. No. 1,461,374 is another self-serve store in which the customers' path or passage through the store is directed by the layout of the store fixtures so as to expose them to the maximum amount of merchandise while directing and controlling the traffic flow.

Smith U.S. Pat. No. 1,463,633 is of general interest only in that it relates to the layout of a restaurant wherein the dining tables are arranged so as to increase the wall line and improve accessability.

Carroll U.S. Pat. No. 1,474,106 is a self-service store intended to be used in limited floor space and wherein the fixtures are arranged to permit operation of the store by one person.

Briggs U.S. Pat. No. 1,528,243 is a self-serve store and has as its main object to provide units or section which permit a rapid and convenient installation of the fixtures. In this regard, the units are constructed so that they can interlock and a more or less modular concept is employed.

Sharp U.S. Pat. No. 1,717,123 is a self-serve store again intended to maximize utilization of the existing floor space while permitting the employees to keep the entire store area under surveillance or observation.

Webb U.S. Pat. No. 1,861,671 discloses a store layout for a self-service store and is primarily directed to the design of the fixtures or display units themselves.

Foulkes U.S. Pat. No. 2,285,962 discloses a design for a shop or store intended to permit quick replenishment of the display units or counters so that the counters themselves do not occupy an excessive amount of the floor space.

Greenspan U.S. Pat. No. 3,742,932 discloses a method and plan for utilization of a floor area although it is directed primarily to a medical office facility and is intended to correlate examining rooms with a common equipment core area.

It is readily apparent that the unique features of the present store arrangement are not found in any of these references.

SUMMARY OF THE INVENTION

It has been found that existing floor space of a retail store site can be utilized to its maximum efficiency while still providing an attractive, unique and aesthetically pleasing layout and this becomes an object of the present invention.

It has been found that this can be accomplished in stores having various configurations and thus more than one embodiment of the invention is illustrated herein.

The principal embodiment of the invention illustrates the store concept utilized in a side-by-side or series arrangement with a plurality of other stores such as might be found in a shopping mall, for example, where all of the stores open onto a common corridor or passageway. The other embodiment of the invention is designed for utilization in the same environment but in a corner location. In either embodiment, of course, the principal components and features of the invention, which are believed significant by Applicant, are common although some modification is necessary depending upon the precise location of the store relative to other stores in the shopping area.

To this end, both embodiments disclose a unique combination of several elements which combine to provide the desired results.

For example, the floor area is bounded by perimeter walls surrounding at least two sides and an end wall with the ends of the perimeter walls framing an entrance. In the case of the corner installation, of course, one of the perimeter walls is an rather short stub type wall.

Additionally, along at least one perimeter wall is mounted a series of what have been called wall display units which include storage areas but, more importantly, present vertical surfaces which can be treated in a unique fashion. These vertical surfaces are treated with a combination of mirror or reflective surfaces and suede or similar material which is of a "first" color. The wall display units also have glass enclosed display areas themselves and these surfaces are covered with a material having a "second" color. The floor of the overall store also has the "second" color.

Also in both embodiments a ceiling, having a mirror or reflective surface is provided and this, in combination with the first and second color arrangement and the mirrored surfaces on the vertical wall surfaces, combine to create a unique effect of spaciousness and unity.

Furthermore, freestanding display units are provided in each embodiment and they are arranged so as to provide an angular or irregular front as contrasted to the conventional straight front presented by a series of display units arranged in end-to-end relationship. Such an arrangement increases both access and visibility to the merchandise without any sacrifice of capacity or security.

Suspended from the reflective ceiling in each embodiment is a canopy which has a configuration corresponding to at least some of the freestanding display units so as to complement and accent the display units.

Accordingly, by utilization of this unique combination of components, the object of providing an aesthetically pleasing yet functionally efficient store layout is achieved. Furthermore, the utilization of the varied mirror surfaces permits an impression of spaciousness notwithstanding the fact that the store may be in a relatively small area. Also, the angular arrangement of at least some of the display units enhances their accessability and the overall efficiency of the store.

Accordingly, production of an improved retail store arrangement of the character above described becomes the principal object of this invention with other objects thereof becoming apparent upon the reading of the following brief specification considered and interpreted in view of the accompanying drawings.

OF THE DRAWINGS

DESCRIPTION OF THE PREFERRED EMBODIMENTS

Figure 1:
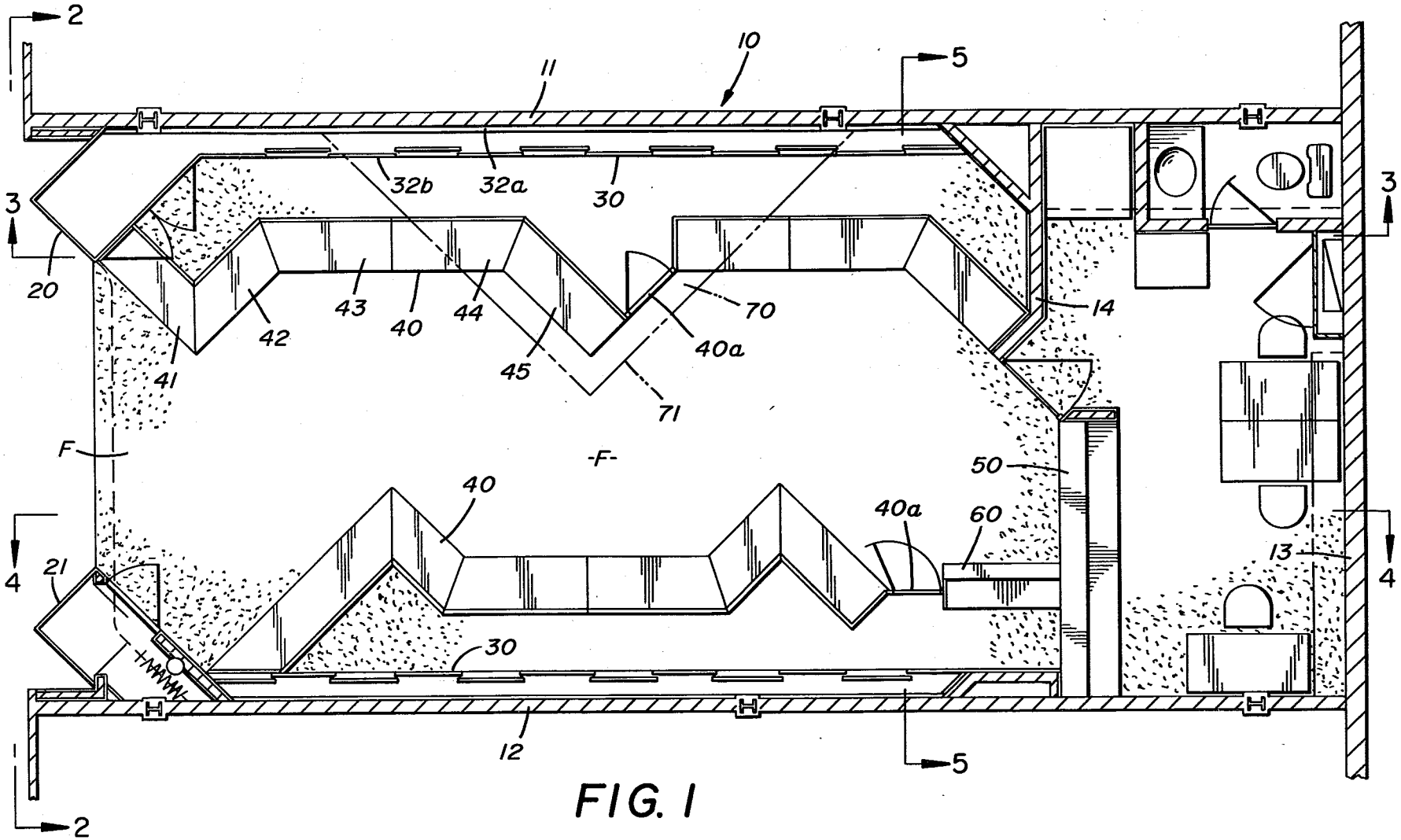
FIG. 1 is a plan view of one embodiment of the invention.

Referring first to FIG. 1 of the drawings, it will be noted that this figure is a plan view of the basic layout of the store. The store is generally indicated by the numeral 10 and includes opposed perimeter walls 11 and 12, a rear wall 13, a floor F and a ceiling C (see FIG. 6). This particular embodiment of the invention is intended for installation in or along with a series of stores arranged side by side wherein the perimeter walls 11 and 12 frame an entrance way. The operative or sales area of the store itself is essentially framed by the perimeter walls 11 and 12 and rear wall 13 and a line drawn between the ends of the perimeter walls 11 and 12. This type of store has particular utility in a shopping center or mall wherein a common central corridor is disposed adjacent the open end of the overall store although it could be used in a freestanding situation also.

Referring in general then to FIG. 1 again, it will be noted that the floor space is essentially divided into two sections by dividing wall 14 and cash and wrap counter 50. These components divide the store into a basic selling area and a basic office, storage and miscellaneous area. It is the selling area which is of primary importance in the present application.

Again, in general terms, the selling area, bounded by perimeter walls 11 and 12 and dividing wall 14 and counter 50, includes end display units 20 and 21, wall display units 30,30, free standing display units 40,40 and counters 50 and 60. Overhanging all of this structure is a canopy or drop ceiling arrangement 70.

Figure 2:
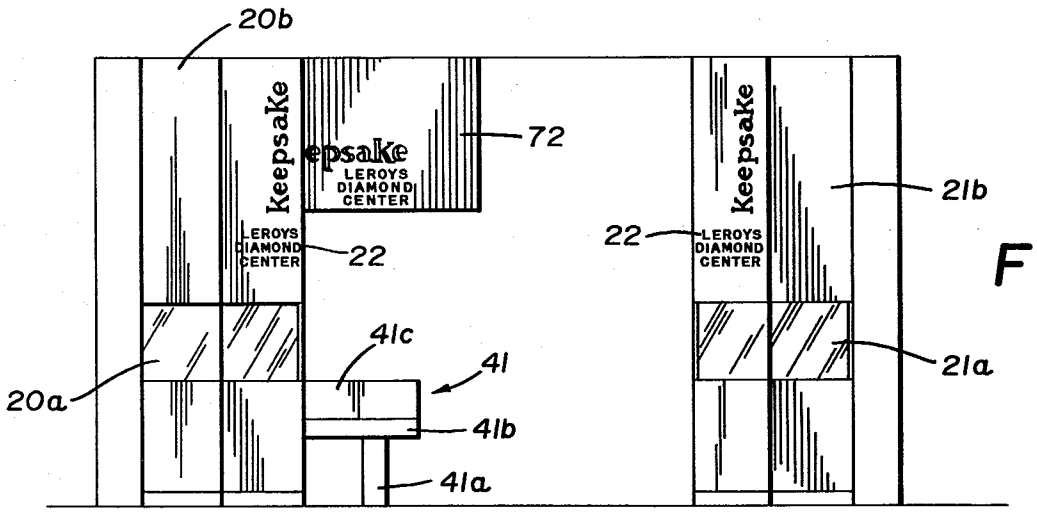
FIG. 2 is an elevational view taken along the line 2—2 of FIG. 1.
Figure 7:
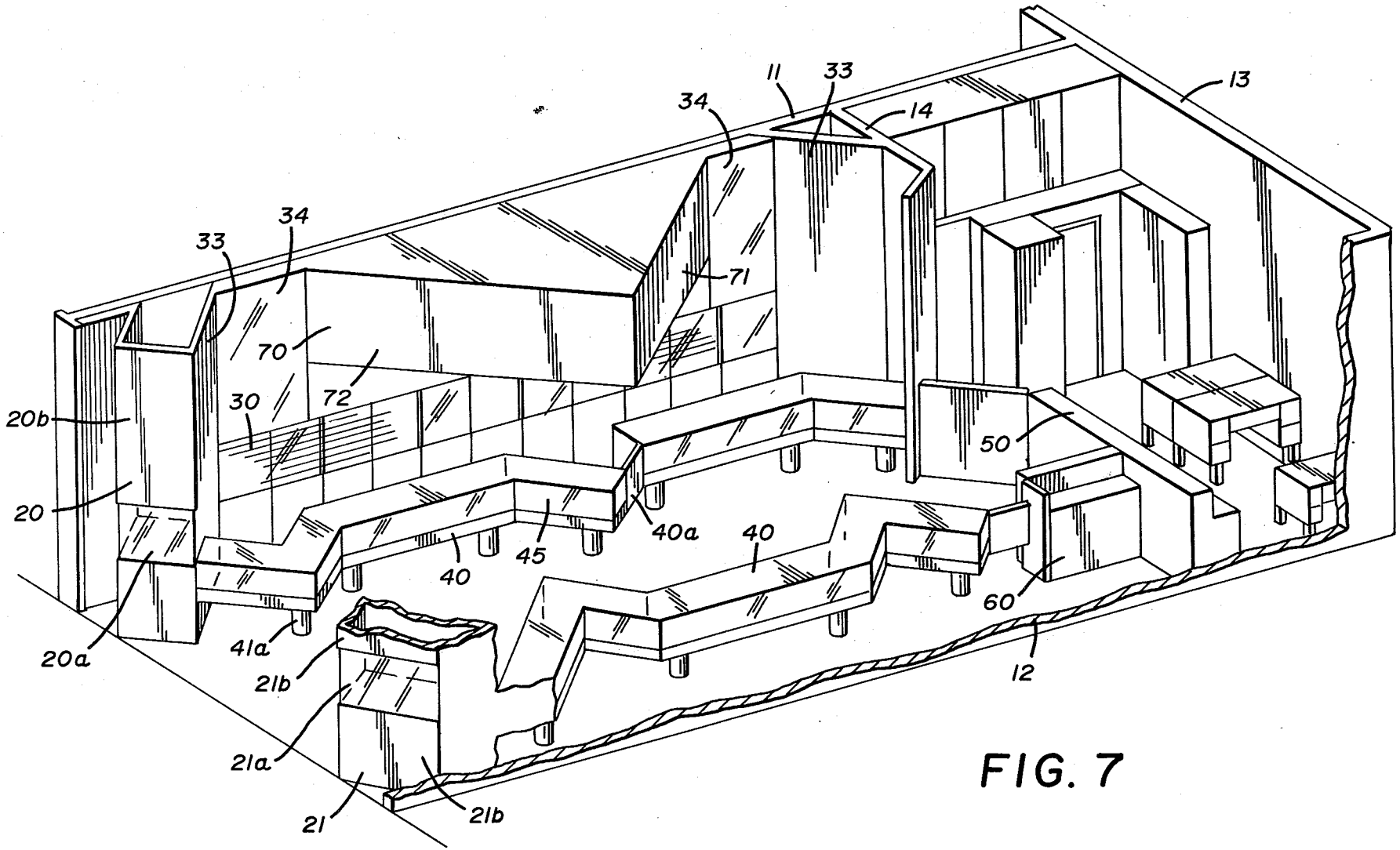
FIG. 7 is a perspective view of the embodiment of FIGS. 1 through 6.

For purposes of general description, reference is made to FIGS. 1, 2 and 7 and particular attention is called to the fact that the freestanding display units, which are generally indicated by the numeral 40, include a plurality of individual display cases 41, 42, 43 which are arranged in end to end relationship, but which have various configurations so that an irregular or angular overall arrangement can be presented. At an intermediate point between the ends of the overall display 40 a door **40*a*** can be provided with the exact location of this door not being critical, but some means of access from the front to the rear of the display cases being necessary.

It will be noted that on opposed sides of the store these freestanding display units 40 are similar, although not necessarily quite identical. The similarity is that they are similarly constructed and are arranged in end to end relationship stretching from the open or access end of the store to the dividing structure of wall 14 and counter 50 and that they are arranged in angular relationship. The exact angular arrangement, however, is not identical on opposed sides of the store although they do complement each other and create a harmonious pattern while maximizing the available floor space.

Also received interiorly of the store is a "cash and wrap" counter 50, which is essentially the sales counter, and a repair counter 60.

Referring to FIG. 2 then for a more detailed description of the freestanding display units such as unit 41, it will be noted that this unit includes support legs **41*a*, a base 41*b* for receipt of the articles to be displayed and a glass enclosure 41*c* which permits, of course, the articles to be readily viewed. All of the various counters 40, 43, 43, etc. have essentially similar components although the exact planar configuration will vary as is clearly evident from FIG. 1** in order to achieve the unique angular relationship therebetween and to present the unique visual effect achieved thereby.

Figure 3:
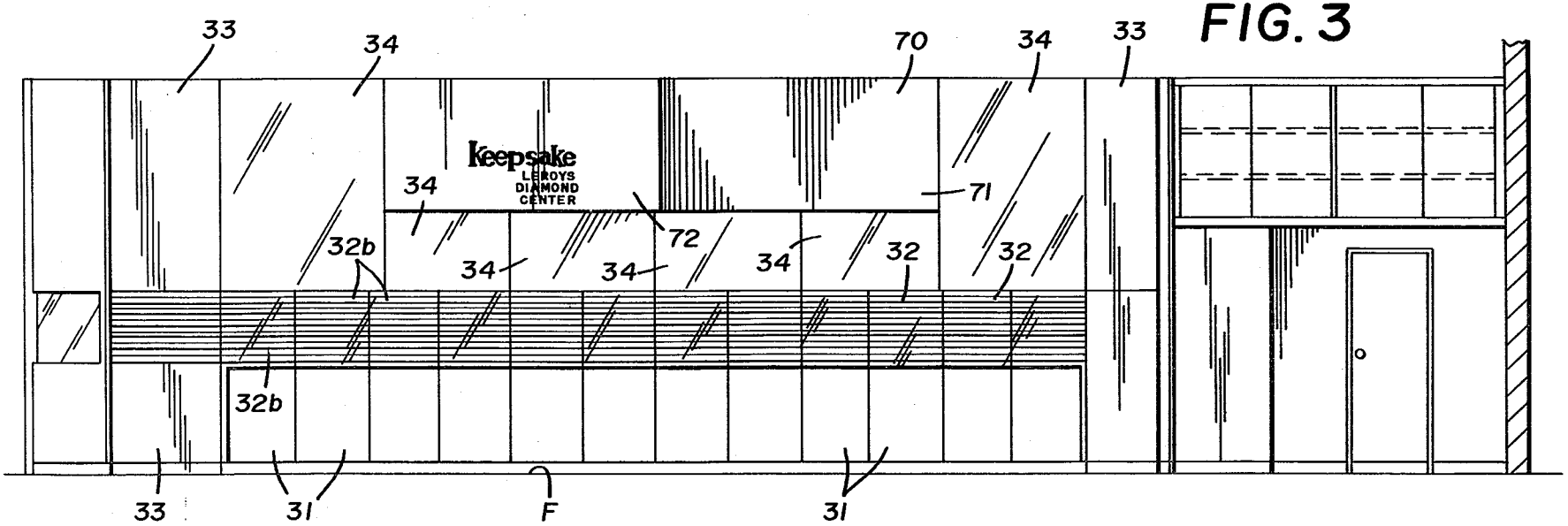
FIG. 3 is an elevational view taken along the line 3—3 of FIG. 1.

Referring to FIG. 3 for a description of the wall display units 30, it will be noted that these essentially include storage units 31,31 which project upwardly from the floor surface F. These are relatively conventional and include sliding doors so that articles can be stored therein.

Directly above the store units 31,31 are display units 32,32. These display units essentially comprise a vertical wall surface **32*a* upon which the articles can be displayed by means of shelves, hooks or any other suitable device and sliding glass doors 32*b* which permit ready access to the articles which are displayed and also permit, of course, the articles to be readily viewed. The wall surface 32*a*** can be of any desirable material, but will be colored with what will be referred to as the "first" color.

Disposed above, the display areas 32 is a vertical wall surface. This wall surface is essentially divided into various components such as suede covered panels or sections 33 and mirror or reflective sections 34. The panels 33 are preferably all of one color which will be referred to herein as the "second" color. The reflective surfaces, when displayed and disposed in conjunction with the remaining components of the overall store layout, provide a sense of spaciousness and also enhance the overall appearance of the store.

Figure 6:
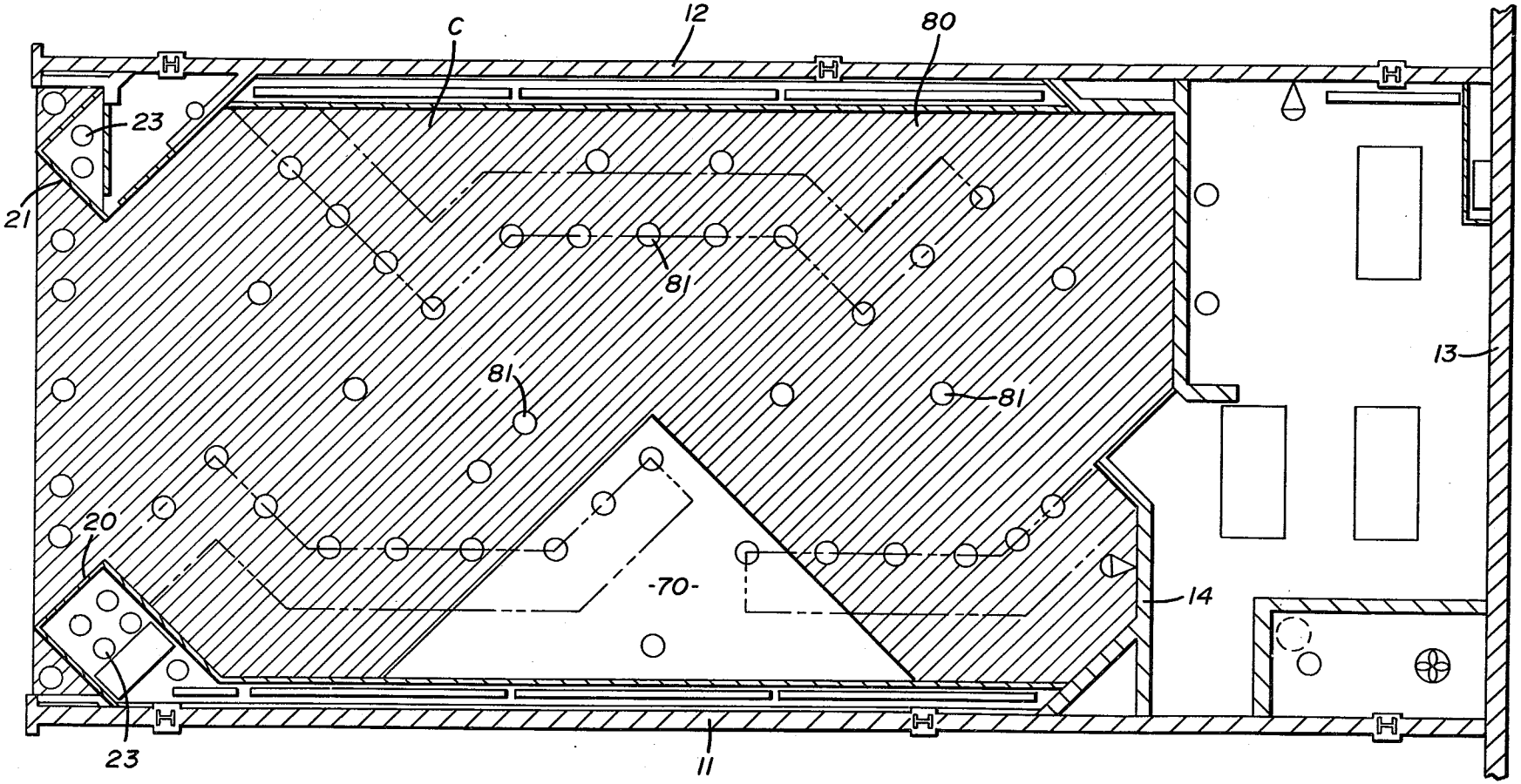
FIG. 6 is a plan view of the ceiling structure of the embodiment of FIGS. 1 through 5.

The ceiling C is illustrated in FIG. 6 and includes a reflective surface 80 of polished aluminum or similar material covering substantially all of the selling area. A number of light fixtures 81,81 are also provided with the precise number and type of such fixtures being determined by the desires and requirements of the individual store site.

Referring then again to FIGS. 1 and 5, it will be noted that a canopy 70 depends from the ceiling (not shown in FIG. 1). This canopy has vertical walls 71,72. An important feature of the canopy 70 is that, to a certain degree, it conforms to the configuration of at least a part of the freestanding display units 40. Reference to FIG. 1 and to FIG. 7 will clearly show this. In that regard, it will be noted that the canopy 70 is essentially triangular in plan with its point corresponding to the point or corner formed on display unit 45. Furthermore, the legs of the triangle of the canopy 70 are on the same plane as the front surfaces of the unit 45 and the door 40*a* so that they present a harmonious overall appearance and complement and accentuate. The walls 70 and 71 are preferably covered with suede and have the "second" color so as to coordinate with the vertical surfaces 33.

The end display units 20 and 21 project from the perimeter walls 11 and 12 and effectively frame the entrance way leading to the common hall or passageway of the shopping center or malls. These units, it will be noted (see FIGS. 2 and 7), consist of a floor to ceiling pedestal of generally rectangular cross section. It will be noted that these units are disposed so that at least one wall thereof will lie in a parallel plane to at least one of the faces of the cabinets 40. In this way, the angular or irregular configuration and the impression created by the display units 40 will be carried out and complemented by the end display units 20 and 21.

These units 20 and 21 also have a display area 20*a* and 21*a*. There is a glass enclosed area having suitable lighting 23 behind or within it so that articles can be readily displayed therein. Also (see FIG. 2) suitable signage 22,22 is provided. This is "back lighted" or illuminated and portrays the name of the store. A similar treatment is provided in the wall 72 of the canopy 70 so that a consistent presentation of the proprietor's identification is included throughout the store.

The outer walls of end display units 20 and 21 are also covered with suede as at 20*b* and 21*b* and have the "second" color while the vertical surfaces within display areas 20*a* and 21*b* have the "first" color.

Part of the present invention involves color. In this regard specific colors are not involved or claimed as being relevant to patentability, however, relative colors and their use in conjunction with the other structural features are considered to contribute to the creation of a new and useful structure.

Thus, it has been found that by providing the vertical display surfaces 32*a* of the wall units 30 and the vertical display surfaces of the display areas 20*a* and 20*b* of the end display cases 20 and 21 of the floor surface F with one color (the "first" color) and the remaining vertical wall surfaces of the canopy 70 and the balance of the perimeter walls and wall cases a "second" color that, in combination with the mirror effect achieved by the reflecting ceiling and the mirrors 34 mounted on the perimeter walls above and about the wall display cases, that a unique sensation of spaciousness and unity can be achieved.

Figure 5:
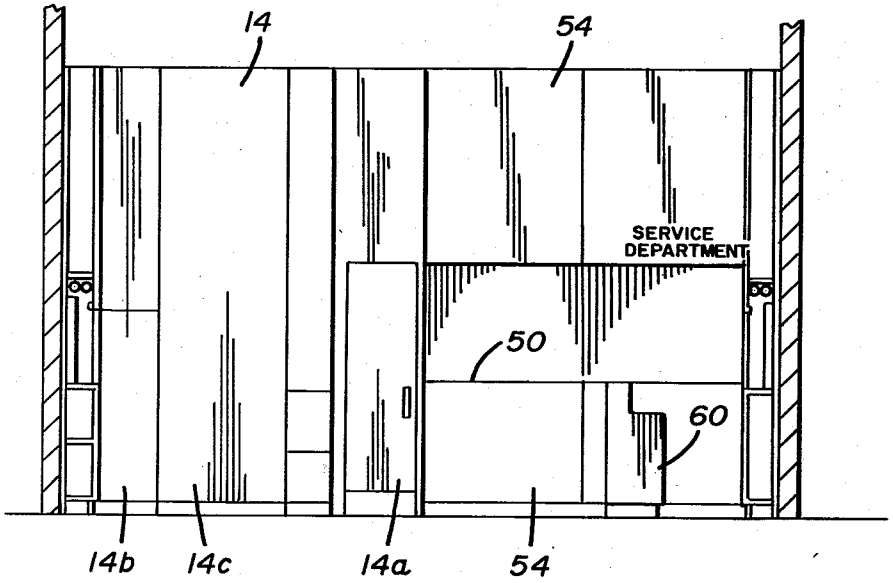
FIG. 5 is an elevational view taken along the line 5—5 of FIG. 1.
Figure 4:
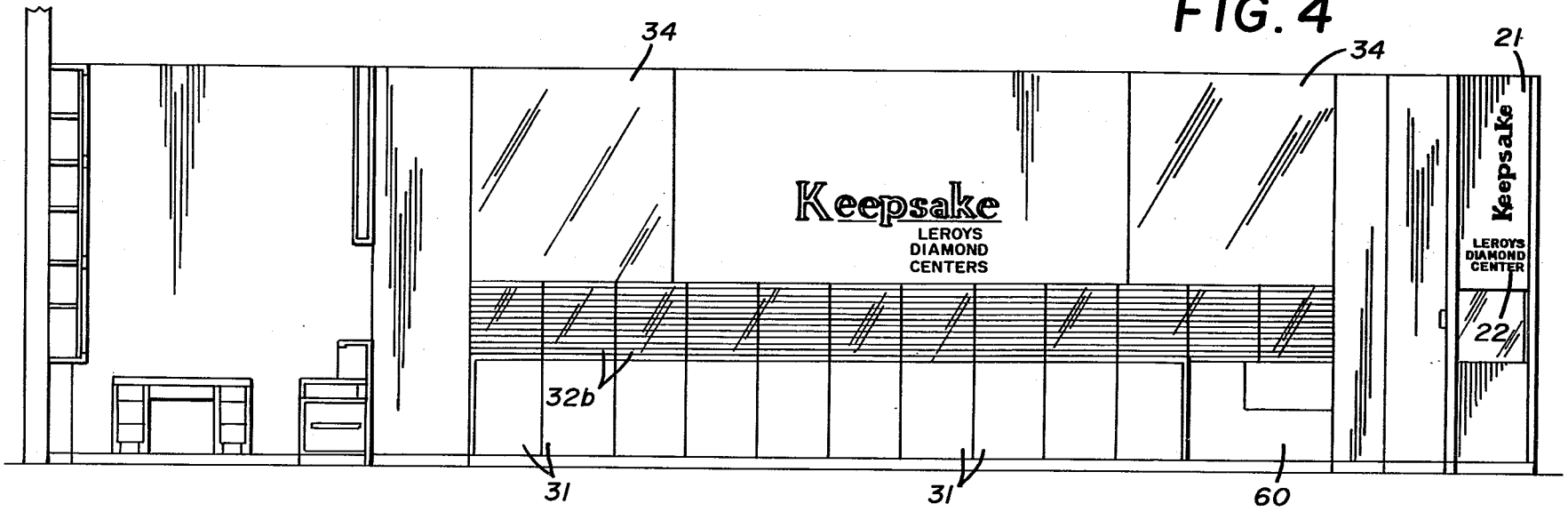
FIG. 4 is an elevational view taken along the line 4—4 of FIG. 1.

To maintain consistency in this pattern, the dividing unit which includes counter 50 and wall 14 are treated in similar fashion as can be seen by FIG. 5. Thus the face 54 of counter 50 is mirror covered while door 14*a* has the "first" color. Wall 14 has mirror surface 14*b* and a "first" color surface 14*c*.

Also, the face of repair counter 60 is suede covered with the "second" color.

The area between partition or dividing wall 14 and counter 50 and the rear perimeter wall 13 has not been described in detail. This area is primarily intended to be used for office and storage purposes and really forms no part of the basic selling area which is the primary subject of this invention.

Turning next then to FIGS. 8 through 14 for a discussion of a modified form of the invention, it will be noted that this form of the invention essentially is intended for utilization in a corner location as contrasted to the form of the invention shown in FIGS. 1 through 7. However, most of the essential components of the store are either identical or quite similar and essentially differ only in two respects.

First, the second perimeter wall does not extend along the entire length of the store, and second, certain freestanding display islands are employed in addition to the wall display units and freestanding display units.

Figure 8:
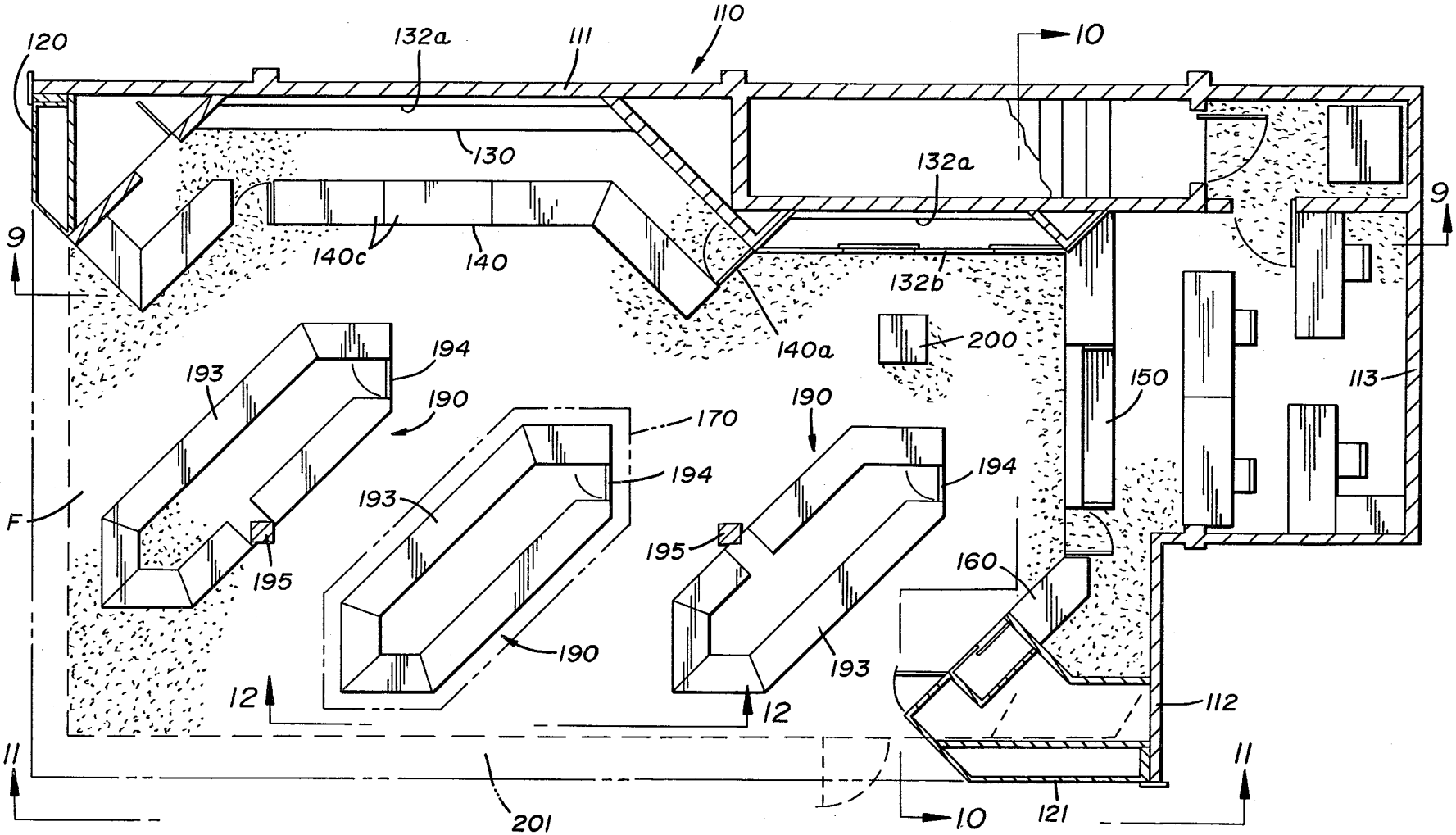
FIG. 8 is a plan view of another embodiment of the invention.
Figure 10:
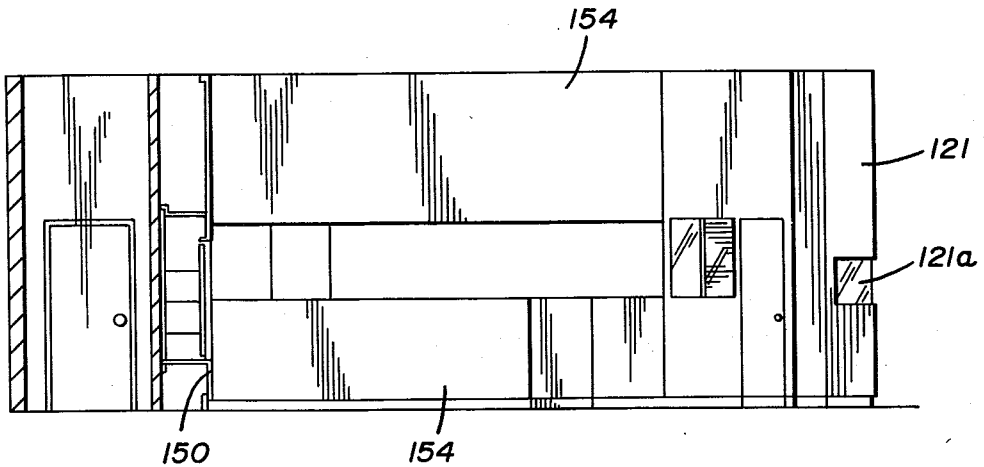
FIG. 10 is an elevational view taken along the line 10—10 of FIG. 8.
Figure 9:
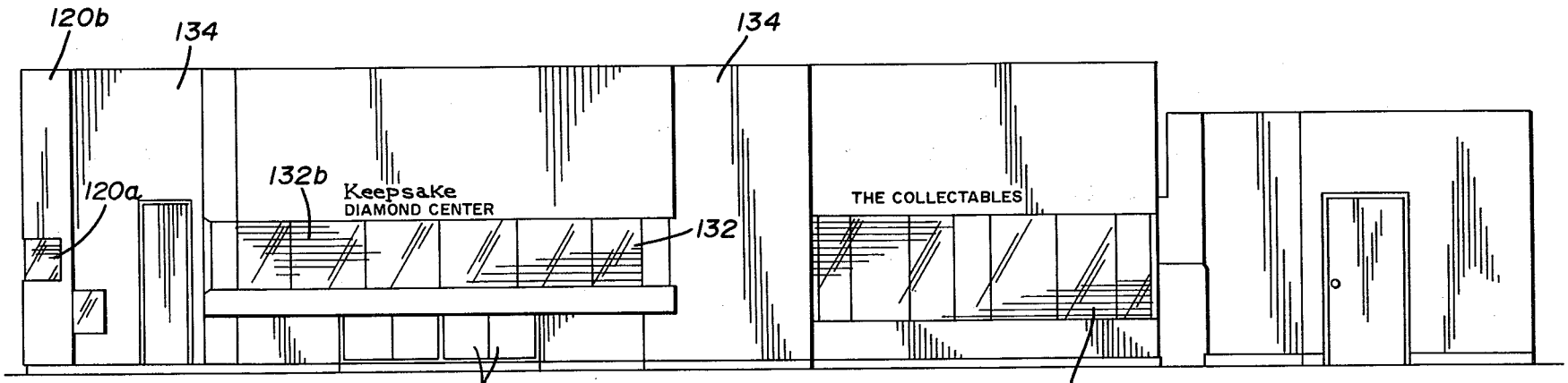
FIG. 9 is an elevational view taken along the line 9—9 of FIG. 8.
Figure 12:
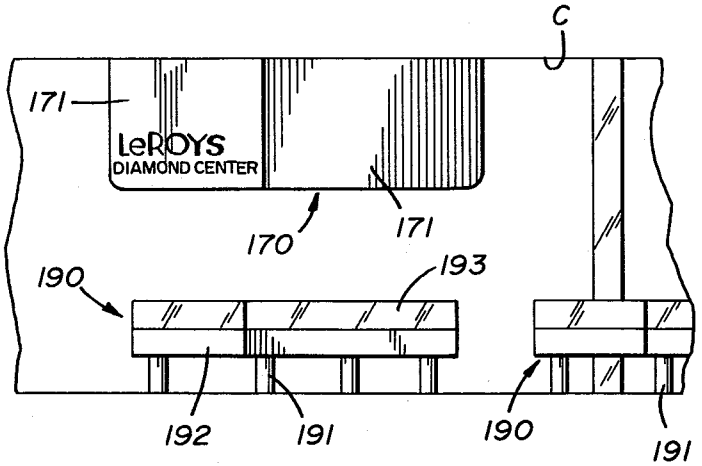
FIG. 12 is a partial elevational view taken along the line 12—12 of FIG. 8.

In discussing the form of the invention illustrated in FIGS. 8 through 14, an attempt has been made to utilize similar reference numbers of the 100 series so that, for example the overall store layout referred to by the numeral 10 in FIG. 1 becomes the layout 110 in FIG. 8.

Figure 11:
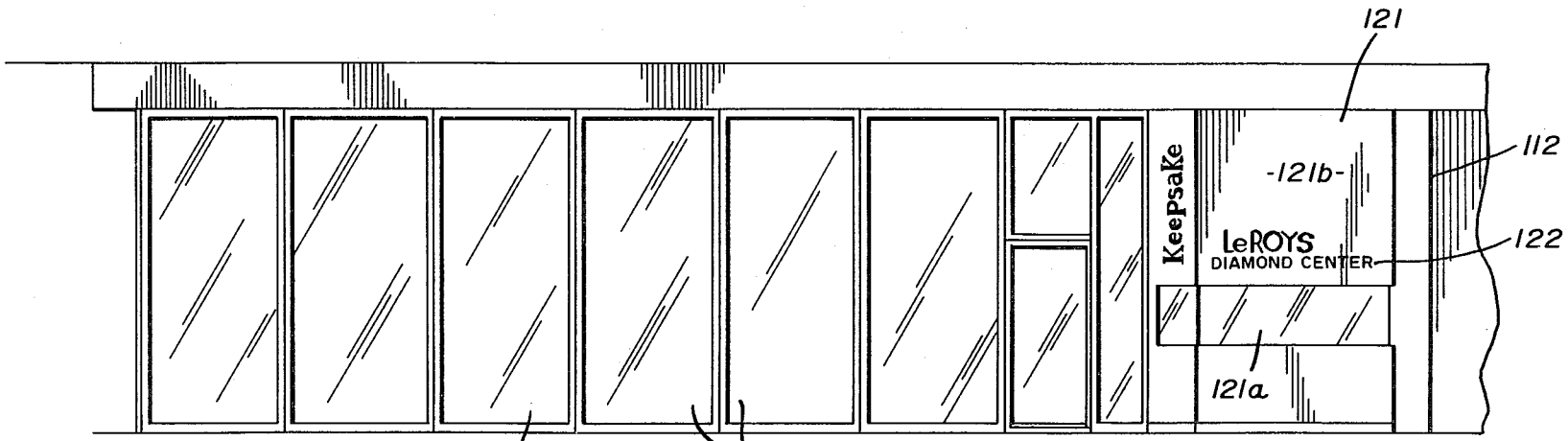
FIG. 11 is an elevational view taken along the line 11—11 of FIG. 8.

Turning then to FIG. 8, perimeter walls 111 and 112 are employed as is a rear wall 113. The perimeter walls frame an entrance way, although that entrance way is somewhat larger than that shown in FIGS. 1 through 7 due to the fact that the store is installed on a corner location and perimeter wall 112 is a relatively short "stub." For security purposes, sliding glass doors 201,201 can be provided to close off the entranceway as illustrated along the side of the store which includes wall 112 as shown in FIG. 11.

Again, the overall store layout 110 is divided into a selling area and a storage and office area by the cash and wrap counter 150 and the repair counter 160.

The ends of the perimeter walls 111 and 112 again include end display units 120 and 121. These differ slightly in cross section from end units 20 and 21, but do present vertical faces which lie in planes parallel to those of the other display units.

Furthermore, wall display units 130, of a type similar to that illustrated and described in connection with the embodiment of FIGS. 1 through 7, are disposed along perimeter wall 111.

Thus, these units include storage units 131,131 and display units 132,132 which again include a vertical wall surface 132*a* of the "first" color and are enclosed by sliding glass doors 132*b*,132*b*.

Freestanding display units 140 are employed in this form of the invention, although in this instance only along one side of the store due to the fact that effectively two sides are open in this embodiment. However, these also embody the same structural components as the units 40 and also are arranged in a similar angular configuration as is clearly evident from FIGS. 8, 9 and 14 of the drawings. Thus the units 140 each include legs 140*a*, bases 140*b* and glass enclosures 140*c*.

The end units 120 and 121 are also virtually identical including the feature of the walls being at least, in some instances, parallel with the planes of the faces of the display units so as to complement and carry out the angular arrangement. These units also include the display areas 120*a* and 121*a* and the lighted signage 122 together with the covered wall surfaces 120*b* and 121*b* and lighting 123.

This embodiment of the invention also differs as noted above, however, by employing certain freestanding islands 190. These are somewhat irregular and six-sided. However, they each include support legs 191,191, an article supporting area 192 and a transparent enclosure 193. Each of them also includes an access door 194. Associated with at least some of the units 190 is a floor to ceiling pedestal 195 which is covered with reflective material such as a mirror. Also a small freestanding unit 200 is provided.

Figure 13:
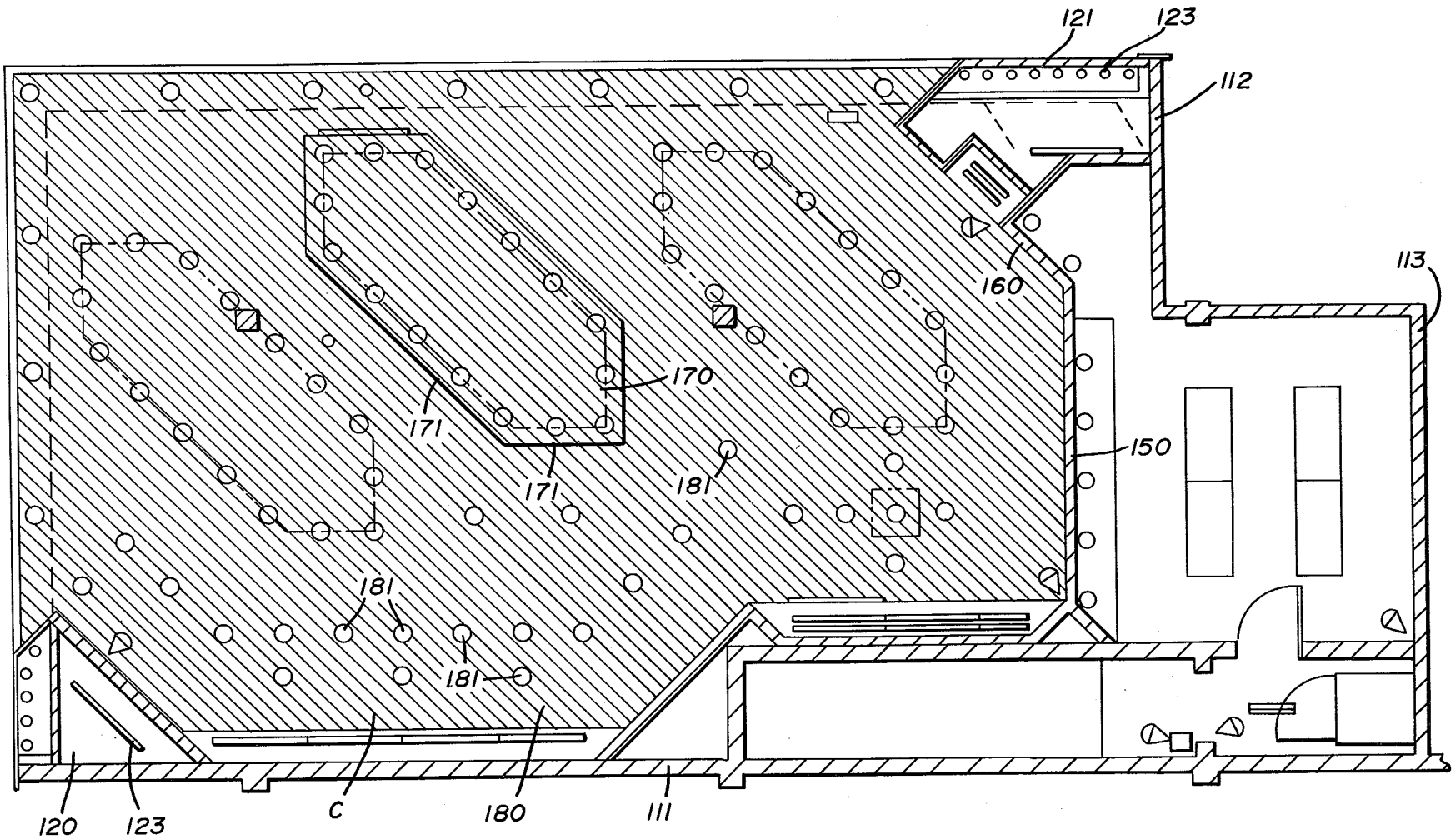
FIG. 13 is plan view of the ceiling structure of the embodiment of FIGS. 8 through 12.
Figure 14:
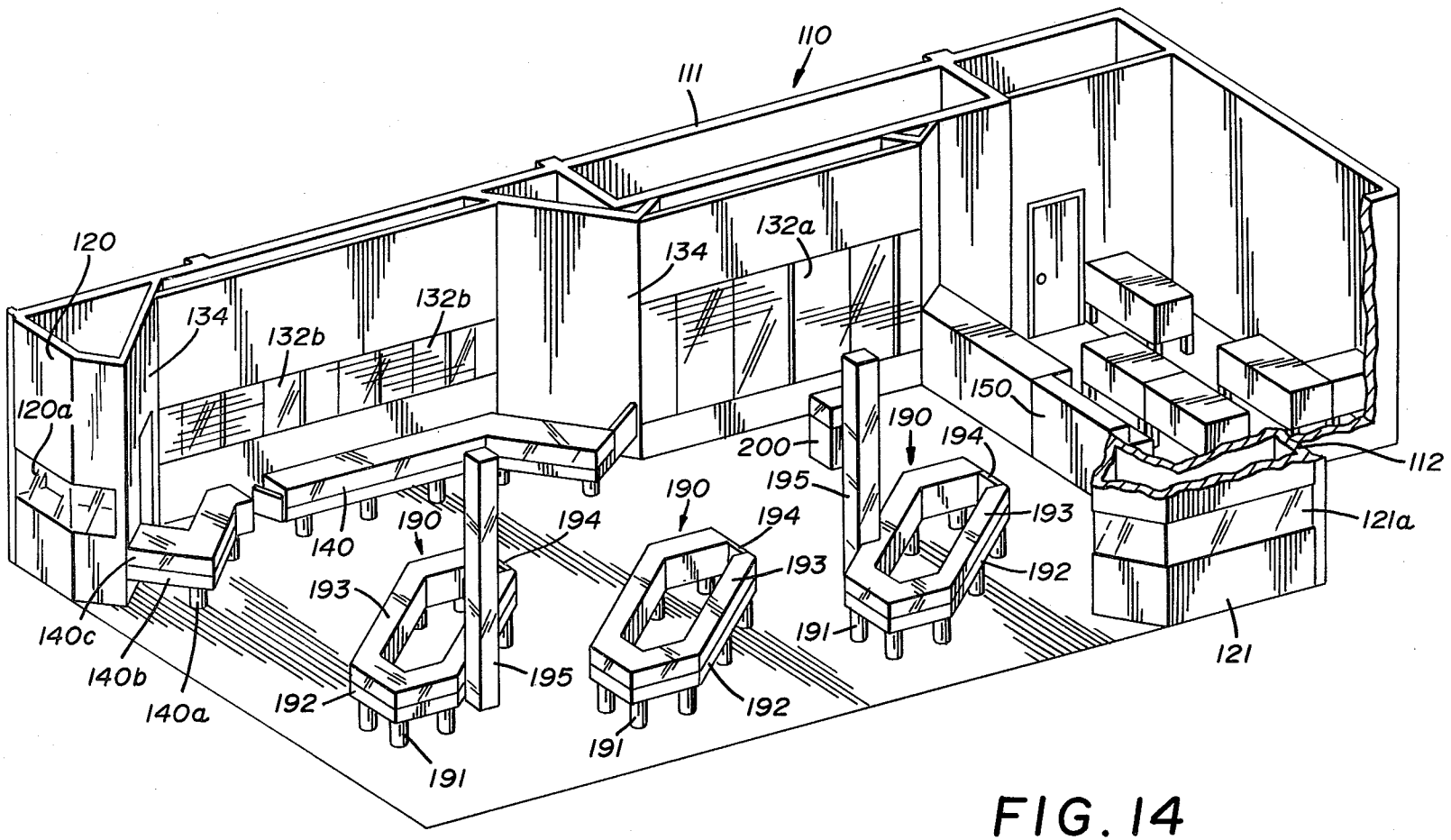
FIG. 14 is a perspective view of the embodiment of FIGS. 8 through 13.

At least one of the islands 190 has associated with it a canopy 170 (see FIGS. 8 and 12) depending from ceiling C (see FIG. 13). This canopy has a plurality of vertical sides 171,171 and at least one of those sides has signage similar to that contained on the end panels 120 and 121.

As is the case with the form of the invention described in connection with FIGS. 1 through 7 of the drawings, the canopy also has a planar configuration which is complemental to that of the islands thereby focusing attention on them and also thereby accentuating, complementing and completing the angular concept which is employed with regard to both the islands and the freestanding display units 140.

Referring to FIG. 13, ceiling C is covered with reflective material 180, and also supports suitable lights 181,181.

The coloring or relative coloring in the form of the invention illustrated in FIGS. 8 through 14 is similar to that of FIGS. 1 through 7 in that essentially, except for fairly neutral areas such as areas which might be made of stainless steel, two colors are employed with the background of the display units being a "first" color in conjunction with the floor F and remaining vertical surfaces being of the "second" color. All of this taken with the reflective features of the columns 195,195 and the surface 180 of ceiling C as well as the mirror surfaces on some of the upstanding walls cooperate to give the feeling of spaciousness and the impression of angularity and the consistency desired.

Furthermore, with both embodiments of the invention, it should be noted that the practical objects of a retail type store are achieved.

First of all, the product or merchandise is readily available for view throughout the store.

Secondly, the desireability of the merchandise is enhanced by the profusion of reflecting surfaces.

Third, accessability for the persons working in the store is also readily enhanced by the design layout. Furthermore, security is achieved without sacrificing the aesthetic appearance of the overall store. The store is compact, but gives the impression of spaciousness and is attractive without sacrificing the utilitarian aspects thereof.

Forth, the angular arrangement of the display units is eyecatching but also permits maximum utilization of the available floor space.

While a full and complete description of the invention has been set forth in accordance with the dictates of the Patent Statutes, it should be understood that modifications can be resorted to without departing from the spirit hereof of the scope of the appended claims.

Thus, while suede has been mentioned as a covering for some of the vertical surfaces, it should be understood that the invention is not intended to be limited to a specific material.

What is claimed is:

1. A store for retail sales, comprising;

(A) perimeter walls enclosing at least two sides of the store area;

(B) wall cases disposed along at least a portion of said perimeter walls;

(C) a plurality of freestanding show cases (1) spaced from said perimeter walls and (2) being disposed in end to end relationship so that their faces form an irregular pattern;

(D) a ceiling bearing a reflective surface; and (E) a canopy (1) suspended from said ceiling in overhanging relationship with at least some of said freestanding show cases (2) and having a configuration conforming to at least a portion of the irregular pattern formed by said show cases.

2. The store of claim 1 wherein (A) the ends of two of said perimeter walls frame an entranceway; and (B) end display cases are disposed on the ends of said perimeter walls and have exposed faces lying in planes parallel to the planes of at least some of said freestanding showcases.

3. The store of claim 1 wherein light sources are disposed in said ceiling and said canopy.

4. The store of claim 1 wherein a plurality of freestanding display islands are disposed on the floor of the store area; said islands having an octagonal planar configuration.

5. The store of claim 4 wherein a canopy having a planar configuration complemental to that of said islands is suspended from said ceiling in overhanging relationship to at least one of said islands.

6. The store of claim 2 wherein said end display cases include:

(A) an enclosed display area;

(B) a back lighted identification sign; and (C) said canopy having a comparable identification sign.

7. The store of claim 4 wherein a plurality of floor to ceiling columns having reflective surfaces are associated with each of said islands.

8. The store of claim 6 wherein (A) said canopy has vertical wall surfaces;

(B) said wall cases include vertical display surfaces;

(C) said end display cases have vertical display surfaces; and (D) said vertical display surfaces of said wall cases, said vertical display surfaces of said end display cases and the floor are a first color and said wall surfaces of said canopy and the remaining vertical wall surfaces of the store are a second color.

* * * * *